United States Patent [19]

Röck et al.

[11] 4,075,735

[45] Feb. 28, 1978

[54] SNAP-TOGGLE HINGE

[75] Inventors: Erich Röck, Hochst; Bernhard Mages, Dornbirn, both of Austria

[73] Assignee: Julius Blum Gesellschaft m.b.H., Hochst, Austria

[21] Appl. No.: 740,242

[22] Filed: Nov. 8, 1976

[30] Foreign Application Priority Data

Nov. 13, 1975 Austria ..... 8673/75

[51] Int. Cl.[2] ..... E05D 11/10; E03D 3/06; E05F 1/14

[52] U.S. Cl. ..... 16/145; 16/50; 16/163; 16/180

[58] Field of Search ..... 16/145, 142, 146, 180, 16/182, 162, 163, 164, 183, 50

[56] References Cited

U.S. PATENT DOCUMENTS 3,363,281 1/1968 Borsani ..... 16/163

3,893,209 7/1975 Sewing et al. ..... 16/164

FOREIGN PATENT DOCUMENTS 674,781 5/1966 Belgium ..... 16/180

2,323,412 9/1974 Germany ..... 16/50

*Primary Examiner*—James Kee Chi

*Attorney, Agent, or Firm*—Wenderoth, Lind & Ponack

[57] ABSTRACT

A snap-toggle hinge includes respective abutment members for attachment to an article of furniture and to a door thereof, the abutment members being pivotally connected together by means of a plurality of pivot arms, a toggle segment being pivotally mounted on one abutment member and provided with a projection receivable in the closed position of the hinge in an opening in a guide member pivotally connected to the other abutment member, the toggle segment being acted on by a spring urging the projection into the opening in the guide member in the closed position.

6 Claims, 4 Drawing Figures

SNAP-TOGGLE HINGE

BACKGROUND OF THE INVENTION

This invention relates to a snap-toggle hinge, in particular for furniture doors or the like.

Snap-toggle hinges permit a door attached thereto to be opened only after a special resistance which holds the door closed has been overcome. Utilising such hinges, an additional door closure device for the article of furniture can be omitted, thus leading to a cost reduction.

Pressure loads between constituent toggle members should not occur in all positions of the hinge, otherwise the respective joints will be subject to premature wear. Also, and in particular in the case of hinges having a swing range of more than 90°, for example approximately 170°–180°, particular attention must be directed to the stability of the hinge. Obtuse angle hinges are inherently more unstable than 90° hinges, because more pivot levers are provided and therefore more bearing points are present.

SUMMARY OF THE INVENTION

It is an object of the invention to provide a snap-toggle hinge wherein excessive loading of the joints of the hinge and instability of the hinge is avoided.

According to the present invention there is provided a snap-toggle hinge comprising respective abutment members for attachment to an article of furniture and to a door thereof. The abutment members are pivotally connected together by means of a plurality of pivot arms. A toggle segment is pivotally mounted on one abutment member and is provided with a projection receivable in the closed position of the hinge in an opening in a guide member pivotally connected to the other abutment member. The toggle segment is acted on by a spring urging the projection into the opening in the guide member in the closed position.

In an advantageous constructional example it is preferably provided that the projection of the toggle segment comprises two mutually perpendicular guide flanges, and that the opening in the guide member is of corresponding shape.

The opening of the guide member may have a convex internal surface over which an abutting surface of the projection of the toggle segment slides when the hinge is moved into or out of the closed position.

The spring may be a compression spring disposed between the toggle segment and one of the pivot arms, the toggle segment being pivotally connected to such arm and being caused by the guide member to pivot relative to such arm and compress the spring when the hinge is opened from the closed position.

BRIEF DESCRIPTION OF THE DRAWINGS

One constructional example of the invention is described below in detail with reference to the accompanying drawings without the invention being limited thereto, wherein.

DETAILED DESCRIPTION OF THE INVENTION

Figure 1:
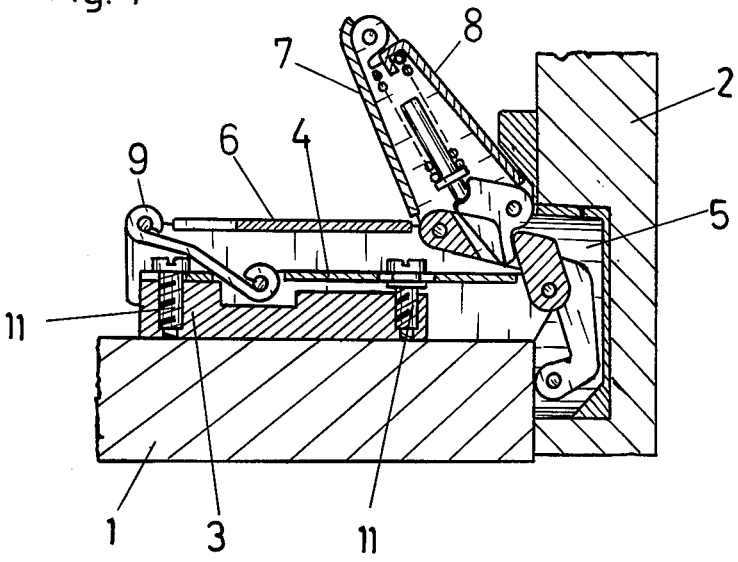
FIG. 1 is a section through a hinge according to the invention in a closed position.
Figure 2:
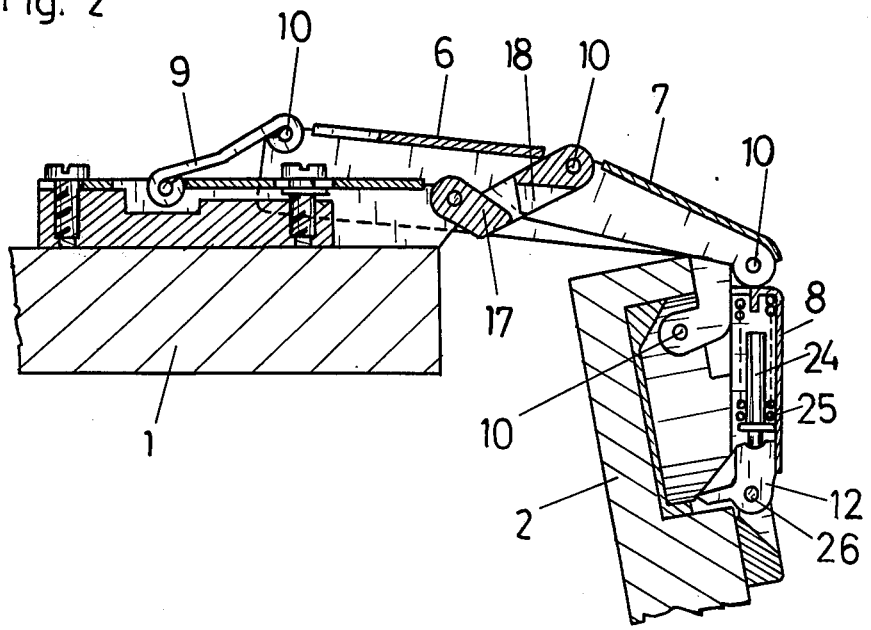
FIG. 2 is a section through the hinge of FIG. 1, but in the open position.

In the drawings, the side wall of an article of furniture is denoted by 1 and the door of the article of furniture by 2. A base plate 3 which supports a fixed arm 4 is fixed in a conventional manner by means of screws, dowels or the like to the side wall 1 of the article of furniture, and a casing 5 is inserted into a recess in the door 2.

The fixed arm 4 and the casing 5 are connected together by means of pivot arms 6, 7 and 8, the pivot arm 6 being pivotally connected to the hinge arm 4 by way of an intermediate arm 9. The connection of the pivot arms to each other and to the hinge arm 4 and the casing 5 is achieved by means of pivot shafts 10. The fixed arm 4 is attached to the base plate 3 by means of screws 11 permitting adjustment of the closed position of the door 2 with respect to the article of furniture.

A toggle segment 12 is pivotally mounted on the casing 5 and has a recess 13 into which engages a guide stub 24 which is loaded by a helical compression spring 25 supported on the pivot lever 8 which is pivoted on the casing 5 on the same shaft 26 as the toggle segment 12.

The toggle segment 12 is provided with a projection 14 which comprises two mutually perpendicular guide flanges 15 and 16.

Figures 3, 4:
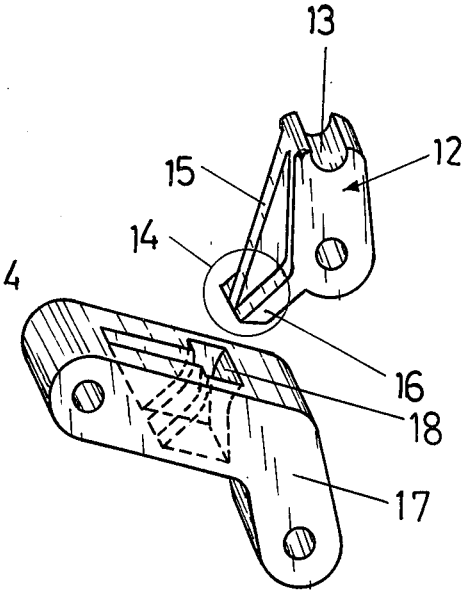
FIG. 3 is a perspective view of a toggle segment of the hinge.
FIG. 4 is a perspective view of a guide member of the hinge.

A guide member 17 is pivotally connected between the hinge arm 4 and the pivot shaft 10 which connects the pivot levers 6 and 7 and is provided with an opening 18 which, as may be seen in particular from FIGS. 3 and 4, is T-shaped in cross-section and corresponds with the projection 14 of the toggle segment 12. The opening 18 has a convex internal surface which abuts with a surface of the flange 16 of the projection 14.

In the closed position of the hinge, as shown in FIG. 1, the projection 14 of the toggle segment 12 extends and is urged by the spring 25 into the opening 18 of the guide member 17. Initial opening of the hinge is resisted since it causes compression of the spring 25 as the flange 16 of the projection 14 slides over the concave internal surface of the opening 18. When the projection 14 becomes free of the opening 18, this resistance ceases.

Owing to this construction of the toggle hinge, no additional load occurs on the pivot lever bearings during closing of the hinge or when the hinge is closed, and furthermore the hinge is guided accurately, to give good stability.

We claim:

1. A snap-toggle hinge for connecting the door of an article of furniture to a side wall of the article of furniture, wherein said door is capable of swinging more than 90° between closed and opened positions thereof, said hinge comprising:

- a first abutment member attachable to a door of an article of furniture;
- a second abutment member attachable to a side wall of said article of furniture;
- a plurality of pivot arm means, connected seriatim, for connecting said first and second abutment members such that said door is swingable with respect to said side wall by an angle of more than 90° between closed and fully opened positions of said door;
- a toggle segment pivotally connected to said first abutment member, said toggle segment having a projection extending therefrom;

a guide member pivotally connected to said second abutment member, said guide member having extending therethrough an opening, said opening being completely laterally enclosed and defined by internal wall surfaces;

said projection extending into said opening when said door is in said closed position, and said projection being without said opening when said door is in said opened position;

one of said internal wall surfaces defining said opening being convex and dimensioned such that a surface of said projection slides against said convex internal surface during movement of said door into and out of said closed position; and spring means for urging said projection into said opening when said door is in said closed position.

2. A hinge as claimed in claim 1, wherein said projection comprises two mutually perpendicular guide flanges, and said opening is of corresponding shape.

3. A hinge as claimed in claim 1, wherein said spring means comprises a compression spring disposed between said toggle segment and a first of said pivot arm means, said toggle segment being pivotally connected to said first pivot arm means and being caused by said guide member to pivot relative to said first arm means and compress said spring when said door is opened from said closed position.

4. A hinge as claimed in claim 1, wherein said pivot arm means comprise a first pivot arm pivotally connected to said first abutment member by a first pivot connection, a second pivot arm pivotally connected to said first pivot arm by a second pivot connection, and a third pivot arm pivotally connected to said second pivot arm by a third pivot connection and to said second abutment member by a fourth pivot connection.

5. A hinge as claimed in claim 4, wherein said first pivot connection comprises a pivot shaft, said toggle segment being pivotally connected to said first abutment member by said pivot shaft.

6. A hinge as claimed in claim 4, wherein said third pivot connection comprises a pivot shaft, said guide member being pivotally mounted on said pivot shaft.

* * * * *